US005973648A

United States Patent [19]

Lindenmeier et al.

[11] Patent Number: 5,973,648

[45] Date of Patent: Oct. 26, 1999

[54] RADIO ANTENNA ARRANGEMENT WITH A PATCH ANTENNA FOR MOUNTING ON OR ADJACENT TO THE WINDSHIELD OF A VEHICLE

[75] Inventors: Heinz Lindenmeier, Planegg; Jochen Hopf, Haar; Leopold Reiner, Gilching; Rainer Kronberger, Höhenkirchen, all of Germany

[73] Assignee: Fuba Automotive GmbH, Salzdetfurth, Germany

[21] Appl. No.: 08/943,289

[22] Filed: Oct. 14, 1997

[30] Foreign Application Priority Data

Oct. 16, 1996 [DE] Germany ..... 196 42 747

[51] Int. Cl.[6] ..... H01Q 1/32

[52] U.S. Cl. ..... 343/713; 343/729; 343/700 MS

[58] Field of Search ..... 343/713, 725, 343/729, 700 MS, 711, 712, 715; H01Q 1/32

[56] References Cited

U.S. PATENT DOCUMENTS

| | | | |
|---|---|---|---|
| 5,610,620 | 3/1997 | Stites et al. | 343/725 |
| 5,650,792 | 7/1997 | Moore et al. | 343/725 |
| 5,805,113 | 9/1998 | Ogino et al. | 343/725 |

FOREIGN PATENT DOCUMENTS 43 39 162 5/1995 Germany .

WO93/23890 11/1993 WIPO .

*Primary Examiner*—Hoanganh Le
*Attorney, Agent, or Firm*—Collard & Roe, P.C.

[57] ABSTRACT

A multiband radio antenna arrangement for use in two way radio communication for (UHF) and (SHF) frequencies. The antenna arrangement contains at least one emitter antenna mounted on the outside of the motor vehicle adjacent to an upper edge of the vehicle's windshield near its roof. Supporting the emitter antenna is a base plate secured adjacent to the roof of the vehicle, the baseplate being electrically conductive and serving as the electrical ground plane for the emitter antenna. A thin antenna line feeds into the antenna and extends from a connection point on the baseplate to the upper edge of the windshield where it is bent and then extended on the inside surface of the windshield through an adhesive bead of the window and into the interior of the vehicle. In addition, connected to the baseplate is a patch antenna connected to the antenna line, the patch antenna for receiving an additional radio communication service. The emitter antenna connects to the antenna line on the baseplate at an emitter connection point. The patch antenna connects to the antenna line on the baseplate at a patch antenna connection point. The combination of the emitter antenna, the antenna line, and a patch antenna are linked to a base plate, to form a combination antenna for multiple band radio communications.

12 Claims, 6 Drawing Sheets

RADIO ANTENNA ARRANGEMENT WITH A PATCH ANTENNA FOR MOUNTING ON OR ADJACENT TO THE WINDSHIELD OF A VEHICLE

BACKGROUND OF THE INVENTION

1. Field of the Invention

The present invention relates to a radio antenna arrangement for radio communications with two way radio communication systems. The two way communications are in the decimeter (UHF) and/or centimeter (SHF) wave lengths, with an antenna element serving as the signal emitter, mounted on the outside of the motor vehicle near the upper edge of a slanted windshield. The emitting antenna is secured on a vehicle body with a base plate mounted on the roof or the windshield, or partly covering the line of separation between the roof and windshield.

2. The Prior Art

Radio antennas similar to this type are known, for example from WO 93/23890, as well as in the form of group antennas in German Patent DE 43 39 162.

These prior art antennas are frequently mounted either on the roof of the vehicle, on the rear window, or on the upper edge of the windshield. In special cases, the antenna can be mounted directly within the separation zone between the upper edge of the windshield and the roof as described in German Patent DE 43 39 162 (FIG. 6).

One of the problems created by these antennas includes finding a way to provide the signal input. There are two problems that can occur in providing the signal input. Firstly, when the antenna is mounted on the windshield, the input signal can be provided using capacitively acting coupling elements in the windshield. Secondly, when it is mounted within the zone of the roof, the input signal has to be fed through a hole provided in the roof, which is undesirable in terms of vehicle construction.

Another problem is that with modern radio systems is that communications with a number of radio communication services frequently have to take place simultaneously. Examples of radio telephone services are the GSM-system (D-network) and the mobile radio telephone system E-network, as well as the AMPS-system used in the USA, which operate in the 800 to 1900 MHz band. In addition to cellular telephone service, satellite radio communication service is also possible, such as, through the Global Positioning System (GPS), or a bidirectional satellite ("Leos"), which is currently in the planning stage, or with a receiving antenna for terrestrial or direct digital audio broadcasting signals in the L-band. All of these services operate in the 1400 to 1600 MHz band.

It is known from previous experience that separately mounting a number of antennas on the vehicle is not widely accepted, so that there is demand for a combination antenna that can receive a number of radio communication services.

SUMMARY OF THE INVENTION

It is therefore an object of the present invention to provide a radio antenna arrangement with a patch antenna for satellite radio communications in a space-saving manner wherein when one antenna is in operation, a strong input signal fed to the compact antenna structure will not interfere with the reception of the other antenna.

It is another object of the invention to provide a windshield antenna for both receiving and transmitting which is simple in design, reliable in operation, and inexpensive in cost.

BRIEF DESCRIPTION OF THE DRAWINGS

Other objects and features of the present invention will become apparent from the following detailed description considered in connection with the accompanying drawings which disclose several embodiments of the invention. It should be understood, however, that the drawings are designed for the purpose of illustration only, and not as a definition of the limits of the invention.

In the drawings, wherein similar reference characters denote similar elements throughout the several views.

DETAILED DESCRIPTION OF PREFERRED EMBODIMENTS

Figure 1A:
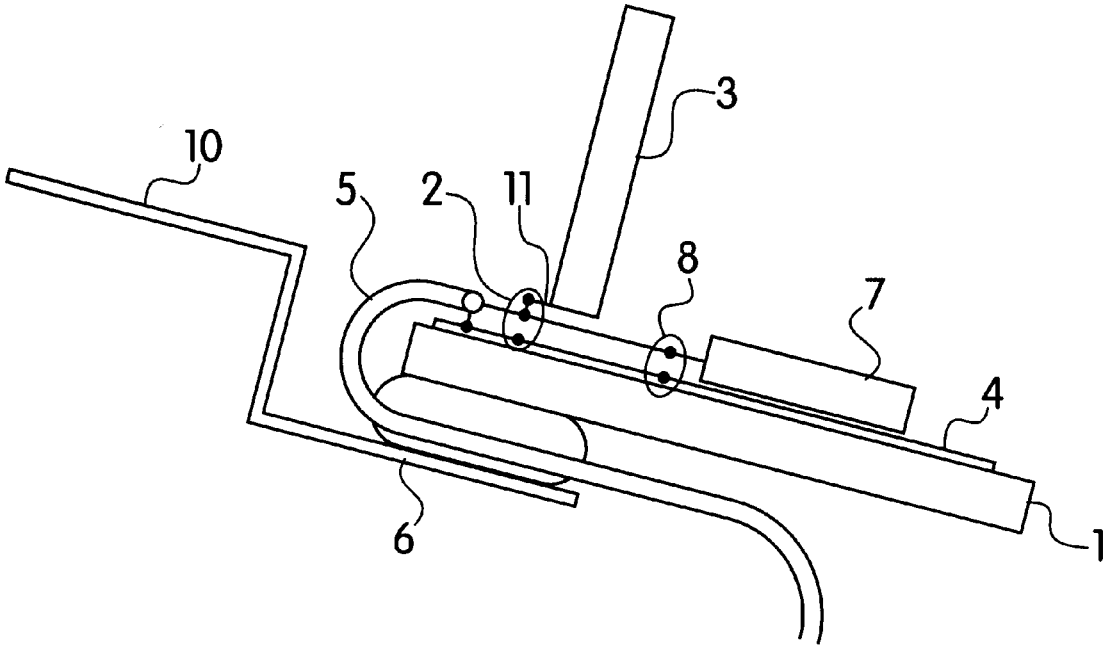
FIG. 1*a* shows an antenna according to the invention installed on the top edge of the windshield of a vehicle, connecting into the interior of the vehicle.
Figure 4A:
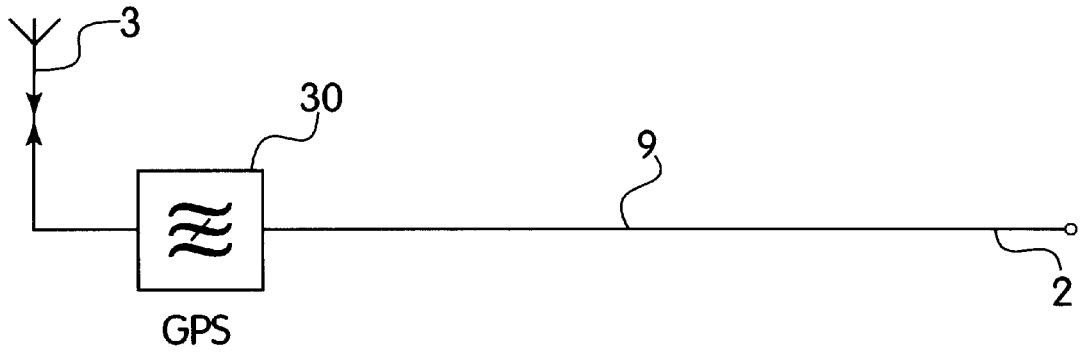
FIG. 4*a* shows an example of a block circuit diagram of the antenna arrangement for GPS reception.

Referring to FIG. 1*a,* there is shown a patch antenna 7 disposed adjacent to a radio antenna 3. A common base plate 4 mounted on windshield 1, serves as an electrical ground plate for both antenna 3 and patch antenna 7. Antenna 3 is designed as a bar antenna. Connected to radio antenna 3 and patch antenna 7 is a thin antenna line 5 extending from connection points 2 and 8 on baseplate 4 of windshield 1. Antenna line 5 extends out from connection points 2 and 8, wraps around windshield 1 extending through adhesive bead 6, into the motor vehicle. In an additional embodiment of the invention, an additional line 9 (FIG. 4*a*) connects to antenna 3 and patch antenna 7 at connection points 2 and 8.

Figure 1B:
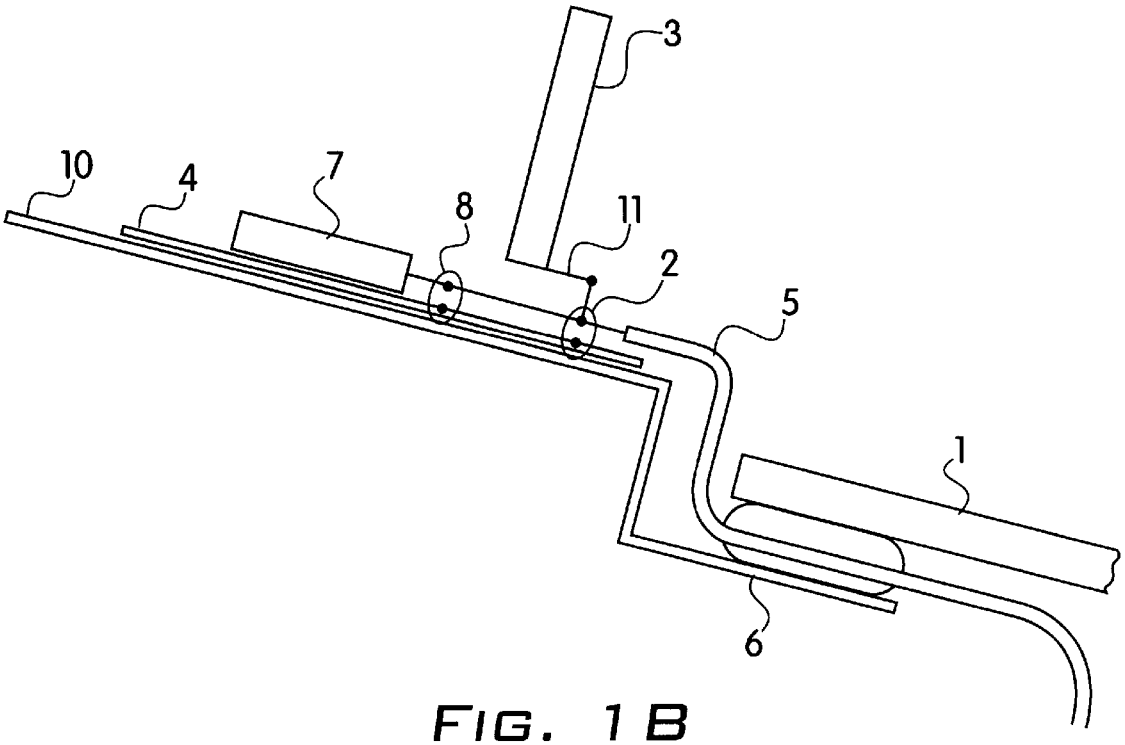
FIG. 1*b* shows the antenna of FIG. 1*a* mounted on the roof edge of the vehicle.

In FIG. 1*b,* base plate 4 is positioned on roof 10 near the edge of window 1. In this embodiment, antenna line 5 extends in an S-like manner through the upper edge of the window 1 of a motor vehicle.

Figure 2:
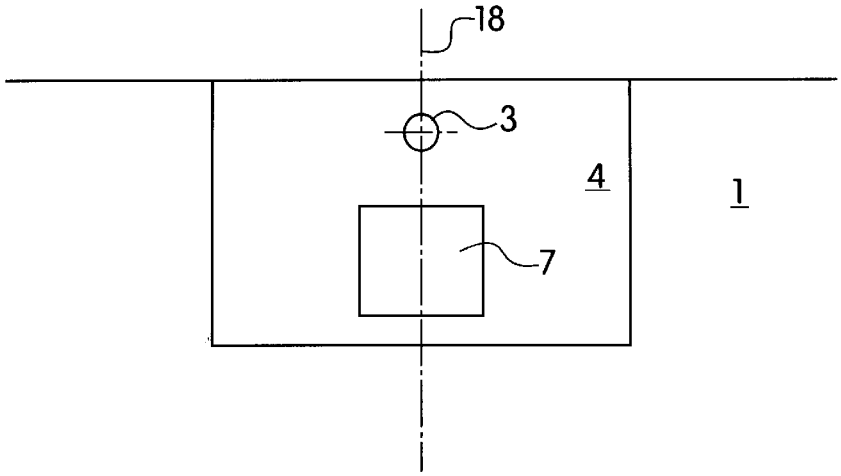
FIG. 2 shows a top view of an antenna according to the invention.

Any radiation that exists between antenna 3, and patch antenna 7 is reduced if patch antenna 7 is orientated toward antenna 3 as shown in FIG. 2. This arrangement shows the center vertical line 18 of a patch edge that coincides with the line of connection of the center of antenna 3 with the center of patch 7 at the lower end of antenna 3. Satellite radio communication services operate for vehicle communications in the frequency range of around 1.5 GHz. The D-network/AMPS-network antennas operate in the frequency range of around 800 MHz and 900 MHz, respectively. The resonance frequencies of the primary antennas and the patch antenna, therefore, are sufficiently separated from each other. Even when the E-network mobile radio service is used with its operating frequency of around 1800 MHz, the separation between frequencies is sufficiently large so that patch antenna and the primary antennas can be disposed adjacent to each other.

Figure 3A:
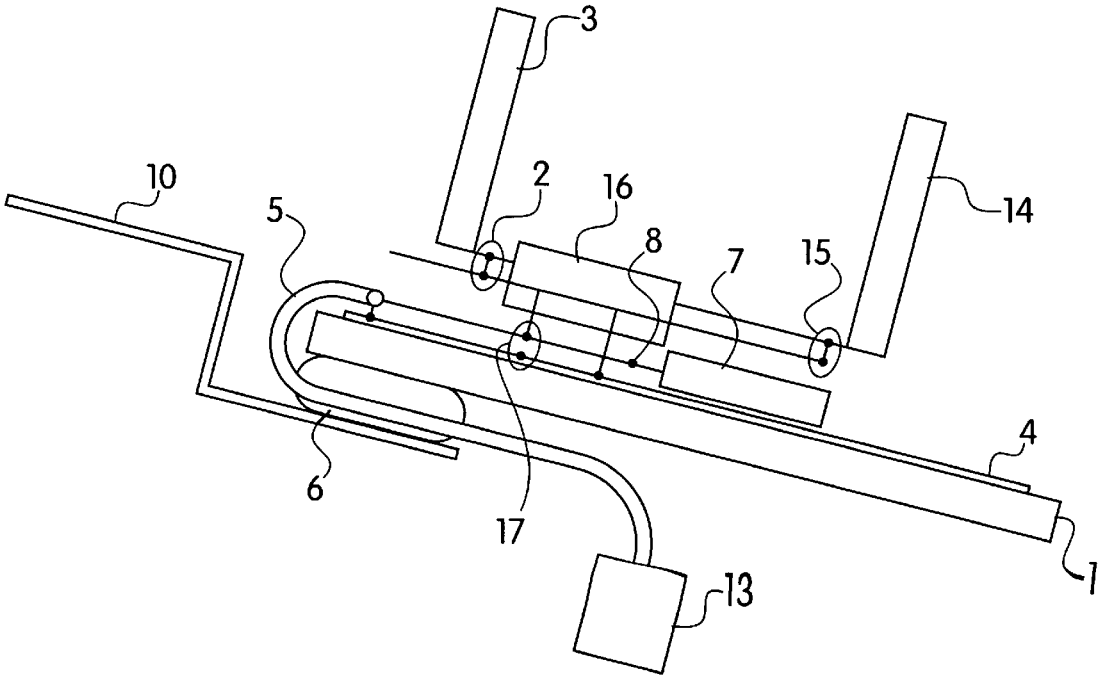
FIG. 3*a* shows a radio grouping of two antennas and a patch antenna mounted on the windshield.
Figure 4B:
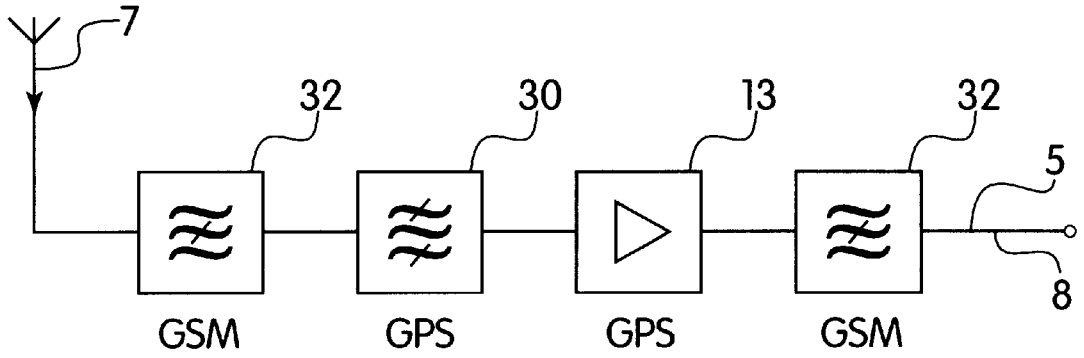
FIG. 4*b* shows an example of a block circuit diagram of the antenna arrangement with band-elimination filters and band pass filters for each of the GSM and GPS radio communication systems.

When GPS-signals are received, a low-noise pre-amplifier 13, as shown in FIG. 4*b,* is connected at the output side of patch antenna 7 and conductor 8 without interconnecting the loss-affected lines. In an advantageous embodiment of the invention, pre-amplifier 13 can also be mounted on base plate 4, in FIG. 3*a*. In this embodiment, patch antenna 7, according to one embodiment of the invention, is disposed in a space-saving manner between two spaced apart antennas 3 and 14 with their associated electrical connection contacts 2 and 15 of the mobile radio telephone. In this embodiment, a network 16 connects radio antenna 3 at connection point 2, radio antenna 14 at connection point 15, and patch antenna 7 at connection point 17. It is an advantage of the invention that the direct current power feed of the GPS-antenna amplifier on base plate 4 be provided via the signal-transmitting conductor of an antenna line. This insures an optimal signal-to-noise ratio in the GPS-receiving unit. The antenna pattern or lobe characteristic of patch antenna 7 is, in its main direction, normally directed at glass pane 1. The wide angle of the antenna lobe, coupled with the flat angles of inclination of front and rear window arrangements commonly used at the present time, assures the required radio contact with the overhead satellites.

Figure 3B:
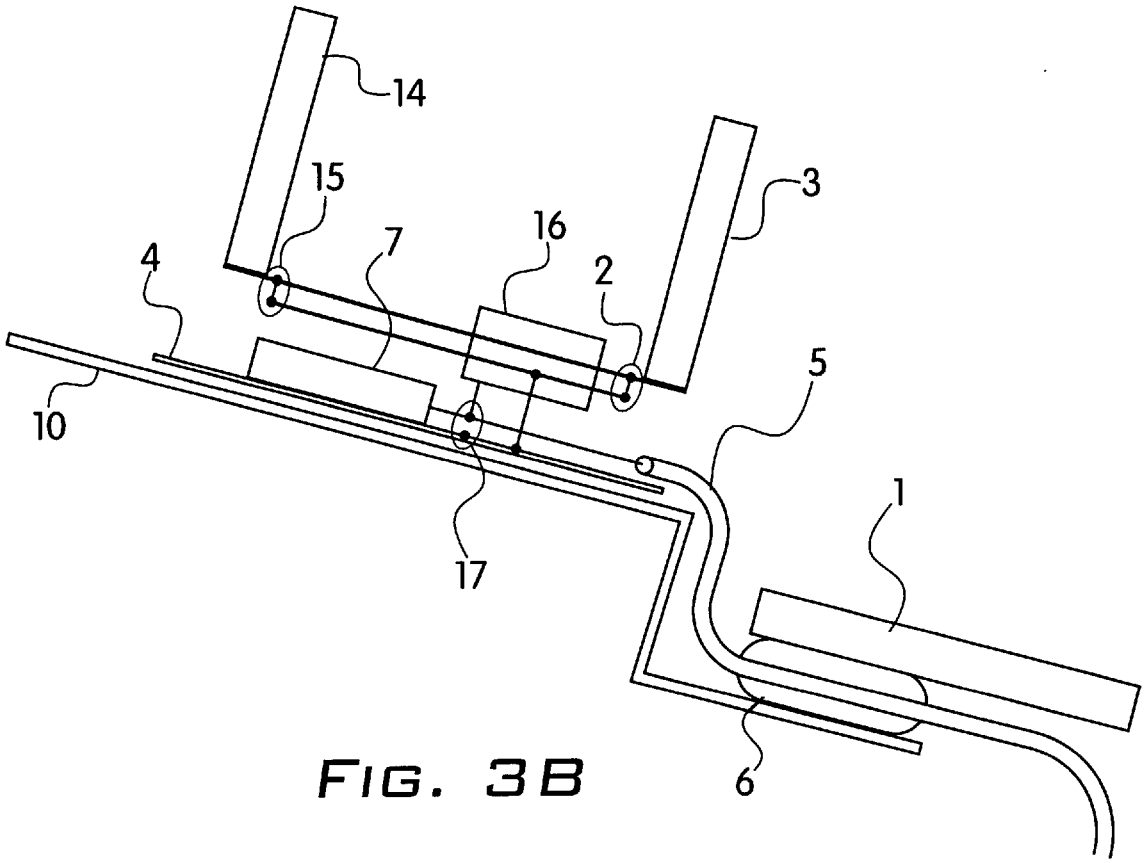
FIG. 3*b* shows a radio grouping of two antennas and a patch antenna mounted on the roof.

An additional embodiment shown in FIG. 3*b,* base plate 4 is positioned on roof 10 with patch antenna 7, emitters 3 and 14 and network 16 positioned above base plate 4.

Static can be a problem along the edge of the mobile radio communication emitters at the receiving frequency of the satellite antenna. Therefore, it is often necessary to suppress this edge emission by means of a band eliminator filter 30 at the frequency of the satellite reception. A band elimination filter is located on additional line 9 and is switched into the signal path between antenna line 5 and the mobile radio communication emitter 3 (see FIG. 4*a*).

Furthermore, a band pass filter 32 can be connected ahead of the emitter antenna and used to shield satellite signals received, and protect against the formation of interference frequencies by the nonlinear effects of signals received by the patch antenna. This filter shields the low-noise amplifier 13, connected to its output against undesirable signals. Because of the extremely high field intensities in the field near the mobile radio communication emitter antenna, it is advantageous to introduce a band elimination filter 30 between the patch antenna and the following circuit described above. The band elimination filter 30 is installed to exclude the nonlinear effects of the system components. According to the invention, a band-eliminating filter connected on the output side of the pre-amplifier 13 serves the same purpose in the mobile radio-telephone frequency range as well (see FIG. 4*b*).

Figure 5:
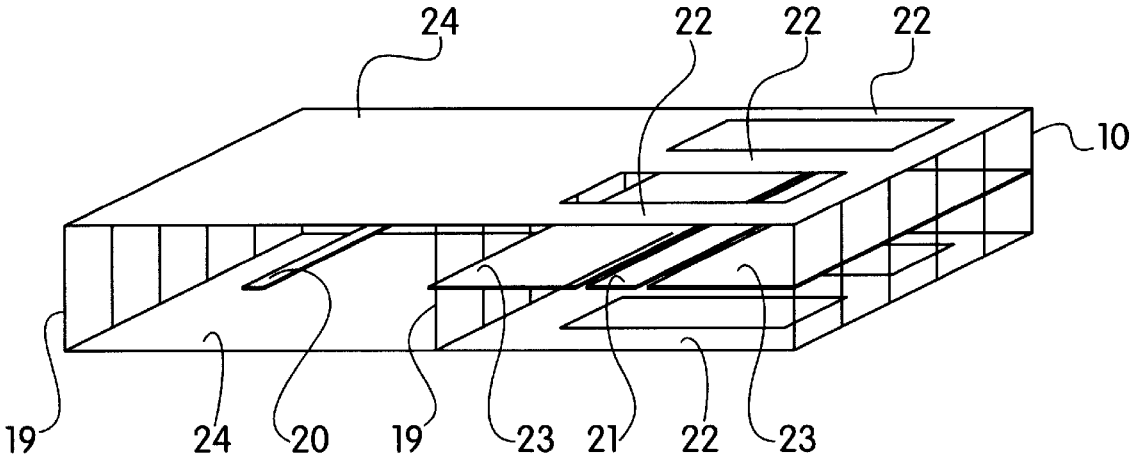
FIG. 5 shows an embodiment of a multiple flat cable line using a three-layer strip line technology.

In addition, many applications require that a flat antenna design be used, as shown in FIG. 5. Preferably, this design of FIG. 5 uses the three-layer strip line technology. In a particularly advantageous embodiment, the antenna is designed as a multiple strip line. Thin microstrip conductors are designed so that the signal transmitting conductor can be extremely narrow to achieve an antenna matching impedance of 50 ohms. To assure a good decoupling between the individual antenna lines of the multiple layer strip line, the latter is designed using the three-layer microstrip technology as in FIG. 5. Here, the signal-transmitting conductor 20 can be embedded in a very narrow form between the two outer ground areas 24. The latter are connected to each other with contacts 19, which are suitably spaced apart. Due to the very narrow width of signal-transmitting conductor 20 of the additional thin antenna lines 9, signals of only relatively low high-frequency power can be received, such as the received power of a satellite signal. Thus, the high frequency power transmitted by the mobile radio-telephone antenna is too high for a conductor of this type.

Therefore, in the embodiment of FIG. 5, a comparatively wide signal transmitting conductor 21 is disposed as the center layer of the three-layer arrangement in the form of a coplanar strip line, and is formed between the wide ground conductors 23. The two outer conductor layers are omitted to avoid excessive capacitances within the range of the coplanar conductor line 21. In order to provide an electrical connection between the outer metal coatings of the multiple line, small conductor bridges 22 are provided at a spacing smaller than the frequency wavelength, so that the line impedance requirement at the respective signal frequency is satisfied. Ground conductors 24 disposed on both sides of the multiple line can be connected to each other using suitably mounted through-contacts 19.

While several embodiments of the present invention have been shown and described, it is to be understood that many changes and modifications may be made thereunto without departing from the spirit and scope of the invention as defined in the appended claims.

What is claimed is:

1. A multiband radio antenna arrangement for use in two way radio communication for UHF and SHF frequencies in a motor vehicle comprising:

at least two emitter antennas forming a first emitter antenna and at least one additional emitter antenna mounted on the outside of the motor vehicle adjacent to an upper edge of the vehicle's windshield near its roof;

a base-plate secured adjacent to the roof of the vehicle, said emitter antennas being mounted on said base plate and projecting therefrom, said baseplate being electrically conductive and serving as the electrical ground plane for said emitter antennas;

at least one thin antenna line extending from a connection point on the baseplate to the upper edge of the windshield where it is bent and then extended on the inside surface of the windshield through an adhesive bead of the window and into the interior of the vehicle;

at least one patch antenna connected to said antenna line for receiving an additional radio communication service, said at least one patch antenna being mounted on said base plate between said first and said at least one additional emitter antennas;

at least one emitter connection point formed by said first emitter antenna and said at least one additional emitter antenna connecting to said baseplate and the antenna line; and a patch antenna connection point formed by the patch antenna connecting to the base plate and the antenna line wherein said first emitter antenna and said at least one additional emitter antenna, said at least one antenna line, and said at least one patch antenna are linked to said base plate, to form a combination antenna for multiple band radio communications a network circuit coupled between said first and said at least one additional emitter antennas, and a group antenna connection point formed on said base plate and coupled to the antenna line for radio communications with a two way radio-telephone.

2. A multiband radio antenna arrangement for use in two way radio communication in a motor vehicle comprising:

a) an electrically conductive base plate secured adjacent to the roof of the vehicle;

b) a first emitter antenna mounted on said base plate;

c) at least one additional emitter antenna mounted on said base plate for forming a group antenna with said first emitter antenna;

d) at least one patch antenna mounted on said base plate between said first and said at least one additional emitter antenna;

e) at least one antenna line extending from a connection point on said baseplate into the motor vehicle;

f) at least one emitter antenna connection point formed by said first and said at least one additional emitter antennas connecting to said baseplate and the antenna line wherein said first emitter antenna and said at least one additional emitter antenna form a group antenna; and g) a patch antenna connection point formed by said at least one patch antenna connecting to said base plate and the antenna line wherein said group antenna, said antenna line and said patch antenna are linked to said baseplate to form a combination antenna for multiband radio communications and said baseplate serves as a ground plane for said group antenna and said patch antenna.

3. The radio antenna arrangement according to claim 2, further comprising a network circuit for coupling said first and said at least one additional emitter antennas together.

4. The radio antenna arrangement according to claim 2, wherein said first emitter antenna, and said at least one additional emitter antenna, are coupled to each other via radiation coupling.

5. The radio antenna arrangement according to claim 2, wherein said first emitter antenna and said at least one additional emitter antenna are vertically orientated bars, and said at least one patch antenna has a center vertical line that coincides with the line of connection of said first emitter antenna.

6. The radio antenna arrangement according to claim 2, further comprising at least one additional antenna line coupled to either said emitter antenna connection point or said patch antenna connection point.

7. The radio antenna arrangement according to claim 6, further comprising at least one bandpass filter connected to said at least one additional antenna line, said at least one bandpass filter passing only signals within the receiving frequency range of said at least one patch antenna.

8. The radio antenna arrangement according to claim 7, wherein said at least one bandpass filter allows said patch antenna to conduct two-way radio telephone communications while shielding radiation from said group antenna.

9. The radio antenna connection arrangement according to claim 6, further comprising at least one low noise pre-amplifier connected to said at least one additional antenna line and further comprising at least one power supply connected to said at least one additional antenna line for powering said at least one low noise pre-amplifier.

10. The radio antenna arrangement according to claim 6, further comprising at least one band elimination filter disposed on said at least one additional antenna line, said at least one band elimination filter for suppressing marginal radiation of the two way radio antenna into said at least one patch antenna, said filter having a band eliminating effect within the frequency range of said at least a one additional emitter antenna.

11. The radio antenna arrangement according to claim 2, wherein said base plate is disposed on a roof of the motor vehicle.

12. The radio antenna arrangement according to claim 2, wherein said base plate is disposed on a rear window of the motor vehicle.

* * * * *